US008299707B2

(12) United States Patent
Liu et al.

(10) Patent No.: US 8,299,707 B2
(45) Date of Patent: Oct. 30, 2012

(54) DISPLAY PANEL

(75) Inventors: Chuan-Feng Liu, Hsinchu (TW); Ya-Rou Chen, Hsinchu (TW); Wei-Lun Su, Hsinchu (TW); Heng-Hao Chang, Hsinchu (TW); Chi-Ming Wu, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 454 days.

(21) Appl. No.: 12/632,806

(22) Filed: Dec. 8, 2009

(65) Prior Publication Data

US 2011/0006661 A1 Jan. 13, 2011

(30) Foreign Application Priority Data

Jul. 9, 2009 (TW) ..... 98123242 A

(51) Int. Cl.
*H05B 33/04* (2006.01)

(52) U.S. Cl. ..... 313/512; 445/25; 313/582

(58) Field of Classification Search ..... 313/512, 313/504, 582; 445/25
See application file for complete search history.

(56) References Cited

U.S. PATENT DOCUMENTS

2005/0140265 A1* 6/2005 Hirakata ..... 313/483
* cited by examiner

*Primary Examiner* — Mary Ellen Bowman
(74) *Attorney, Agent, or Firm* — Chun-Ming Shih

(57) ABSTRACT

A display panel includes a first substrate, a display layer, a second substrate and a water-proofing frame. The first substrate has a view area and a ring-shaped through trench and includes a first base, a first metal layer, a gate-insulating layer, a second metal layer, a semiconductor layer, a bibulous insulating layer and a pixel-electrode layer. The gate-insulating layer is disposed between the first and the second metal layers. The bibulous insulating layer is disposed on the second metal layer and the gate-insulating layer. The ring-shaped through trench passes through the bibulous insulating layer and the part of the gate-insulating layer exposed by the second metal layer and surrounds the view area. The water-proofing frame is disposed at the ring-shaped through trench, connects the first substrate and the second substrate and encloses a wet-proof space between the first substrate and the second substrate. Besides, another display panel is also provided.

11 Claims, 8 Drawing Sheets

DISPLAY PANEL

BACKGROUND

This application claims priority to a Taiwan application No. 098123242 filed on Jul. 9, 2009.

1. Field of the Invention

The present invention generally relates to an electronic device and more particularly to a display panel.

2. Description of Prior Art

FIG. 1A is a schematic top view of a conventional display panel. FIG. 1B is a schematic top view of one of the pixel unit areas of the display panel shown in FIG. 1A. FIG. 1C is a cross-sectional view of the display panel of FIG. 1A taken along line A-A. FIG. 1D is a cross-sectional view of the pixel unit area of FIG. 1B taken along line B-B. It should be pointed out that for the convenience of illustration, some elements of the display panel are omitted in FIG. 1A and the pixel electrode in FIG. 1B is represented by a broken line. Referring to FIGS. 1A, 1B, 1C and 1D, a conventional electrophoretic display panel 100 includes a first substrate 110, an electrophoresis layer 120, a second substrate 130 and a water-proofing frame 140. The first substrate 110 has a view area V1 and includes a first base 111, a circuit layer 112, a passivation layer 113, a bibulous planarization layer 114 and a pixel-electrode layer 115.

The circuit layer 112 is disposed on the first base 111 and includes a plurality of data lines 112*a*, a plurality of scan lines 112*b* and a plurality of switching elements 112*c*. Each of the switching elements 112*c* is a thin-film transistor (TFT). A plurality of pixel unit areas P1 are separated by the data lines 112*a* and the scan lines 112*b*. The pixel unit areas P1 are located in the view area V1. Each of the switching elements 112*c* is electrically connected to one of the data lines 112*a* and one of the scan lines 112*b*. Each of the switching elements 112*c* is disposed in one of the pixel unit areas P1.

The passivation layer 113 is disposed on the first base 111 and the circuit layer 112. The bibulous planarization layer 114 composed of resin is disposed on the passivation layer 113. The passivation layer 113 and the bibulous planarization layer 114 expose a part of each of the switching elements 112*c*. The exposed part of each of the switching elements 112*c* is a drain electrode D1 thereof. The pixel-electrode layer 115 is disposed on the bibulous planarization layer 114 and includes a plurality of pixel electrodes 115*a* respectively corresponding to the pixel unit areas P1. Each of the pixel electrodes 115*a* is located in the view area V1 and electrically connected to the exposed part of one of the switching elements 112*c*. That is, each of the pixel electrodes 115*a* is electrically connected to the drain electrode D1 of one of the switching elements 112*c*.

The electrophoresis layer 120 is disposed on the pixel-electrode layer 115 and corresponds to the view area V1 of the first substrate 110. The second substrate 130 is disposed on the electrophoresis layer 130 and includes a second base 132 and a common-electrode layer 134. The common-electrode layer 134 is disposed between the second base 132 and the electrophoresis layer 120. The water-proofing frame 140 is disposed on the bibulous planarization layer 114 and surrounds the view area V1. The water-proofing frame 140 connects the first substrate 110 and the second substrate 130. The electrophoresis layer 120 is disposed in a space surrounded by the water-proofing frame 140.

However, when the conventional electrophoretic display panel 100 is used in a moist environment, the bibulous planarization layer 114 of which the thickness is low still absorb moisture from the air and then the moisture from outer environment comes into the view area V1 of the first substrate 110 of the electrophoretic display panel 100. Therefore, the switching elements 112*c* in the view area V1 and the electrophoresis layer 120 corresponding to the view area V1 may be damaged due to the invasion of moisture from the outer environment such that the reliability of the electrophoretic display panel 100 is reduced.

BRIEF SUMMARY

The present invention is directed to provide a display panel of which elements in a view area is isolated from moisture of outer environment.

The present invention provides a display panel comprising a first substrate, a display layer, a second substrate and a water-proofing frame. The first substrate has a view area and a ring-shaped through trench and includes a first base, a first metal layer, a gate-insulating layer, a second metal layer, a semiconductor layer, a bibulous insulating layer and a pixel-electrode layer. The first metal layer is disposed on the first base. The gate-insulating layer is disposed on the first base and covers at least a part of the first metal layer. The second metal layer is disposed on the gate-insulating layer and exposes a part of the gate-insulating layer. The semiconductor layer is disposed on the first base. A plurality of switching elements are composed of the first metal layer, the second metal layer, the gate-insulating layer and the semiconductor layer. The switching elements are disposed in the view area.

The bibulous insulating layer is disposed on the second metal layer and the gate-insulating layer. The ring-shaped through trench passes through the bibulous insulating layer and the part of the gate-insulating layer exposed by the second metal layer and the ring-shaped through trench surrounds the view area. The pixel-electrode layer is disposed on the bibulous insulating layer and includes a plurality of pixel electrodes. Each of the pixel electrodes is disposed in the view area and electrically connected to one of the switching elements.

The display layer is disposed on the pixel-electrode layer and corresponds to the view area. The second substrate is disposed on the display layer and includes a second base and a common-electrode layer. The common-electrode layer is disposed between the second base and the display layer. The water-proofing frame is disposed at the ring-shaped through trench, connects the first substrate and the second substrate and encloses a wet-proof space between the first substrate and the second substrate. The view area, the display layer, part of the bibulous insulating layer and part of the gate-insulating layer are disposed in the wet-proof space.

In one embodiment of the present invention, the bibulous insulating layer comprises a passivation layer and a bibulous planarization layer. The passivation layer is disposed on the second metal layer and the gate-insulating layer. The bibulous planarization layer is disposed on the passivation layer.

In one embodiment of the present invention, the bibulous insulating layer is a bibulous planarization layer.

In one embodiment of the present invention, the water-proofing frame is adhesive so as to bond the first substrate and the second substrate.

In one embodiment of the present invention, the display layer is an electrophoresis layer, a liquid crystal layer or an organic light-emitting diode (OLED) layer.

The present invention provides another display panel comprising a first substrate, a display layer, a second substrate and a water-proofing frame. The first substrate has a view area and includes a first base, a first metal layer, a gate-insulating layer, a second metal layer, a semiconductor layer, a bibulous insulating layer and a pixel-electrode layer. The first metal layer is disposed on the first base. The gate-insulating layer is disposed on the first base and covers at least a part of the first metal layer. The second metal layer is disposed on the gate-insulating layer and exposes a part of the gate-insulating layer. The semiconductor layer is disposed on the first base. A plurality of switching elements are composed of the first metal layer, the second metal layer, the gate-insulating layer and the semiconductor layer. The switching elements are disposed in the view area.

The bibulous insulating layer is disposed on the second metal layer and the gate-insulating layer. The pixel-electrode layer is disposed on the bibulous insulating layer and includes a plurality of pixel electrodes. Each of the pixel electrodes is disposed in the view area and electrically connected to one of the switching elements.

The display layer is disposed on the pixel-electrode layer and corresponds to the view area. The second substrate is disposed on the display layer and includes a second base and a common-electrode layer. The common-electrode layer is disposed between the second base and the display layer. The water-proofing frame surrounds the view area, connects the first substrate and the second substrate and encloses a wet-proof space between the first substrate and the second substrate. The view area, the display layer, the bibulous insulating layer and the part of the gate-insulating layer exposed by the second metal layer are disposed in the wet-proof space.

In one embodiment of the present invention, the bibulous insulating layer comprises a passivation layer and a bibulous planarization layer. The passivation layer is disposed on the second metal layer and the gate-insulating layer. The bibulous planarization layer is disposed on the passivation layer.

In one embodiment of the present invention, the bibulous insulating layer is a bibulous planarization layer.

In one embodiment of the present invention, the water-proofing frame is adhesive so as to bond the first substrate and the second substrate.

In one embodiment of the present invention, the display layer is an electrophoresis layer, a liquid crystal layer or an OLED layer.

The water-proofing frame connects the first substrate and the second substrate and encloses a wet-proof space between the first substrate and the second substrate and the view area, the display layer and at least a part of the bibulous insulating layer are disposed in the wet-proof space. Thus, compared with the prior art, the switching elements in the view area and the display layer corresponding to the view area of the display panel of the embodiment of the present invention can not be affected inversely or damaged by the moisture from outer environment such that the reliability of the display panel is improved.

BRIEF DESCRIPTION OF THE DRAWINGS

The accompanying drawings are included to provide a further understanding of the invention, and are incorporated in and constitute part of this specification. The drawings illustrate embodiments of the invention and, together with the description, serve to explain the principles of the invention.

DETAILED DESCRIPTION

Figure 1A:
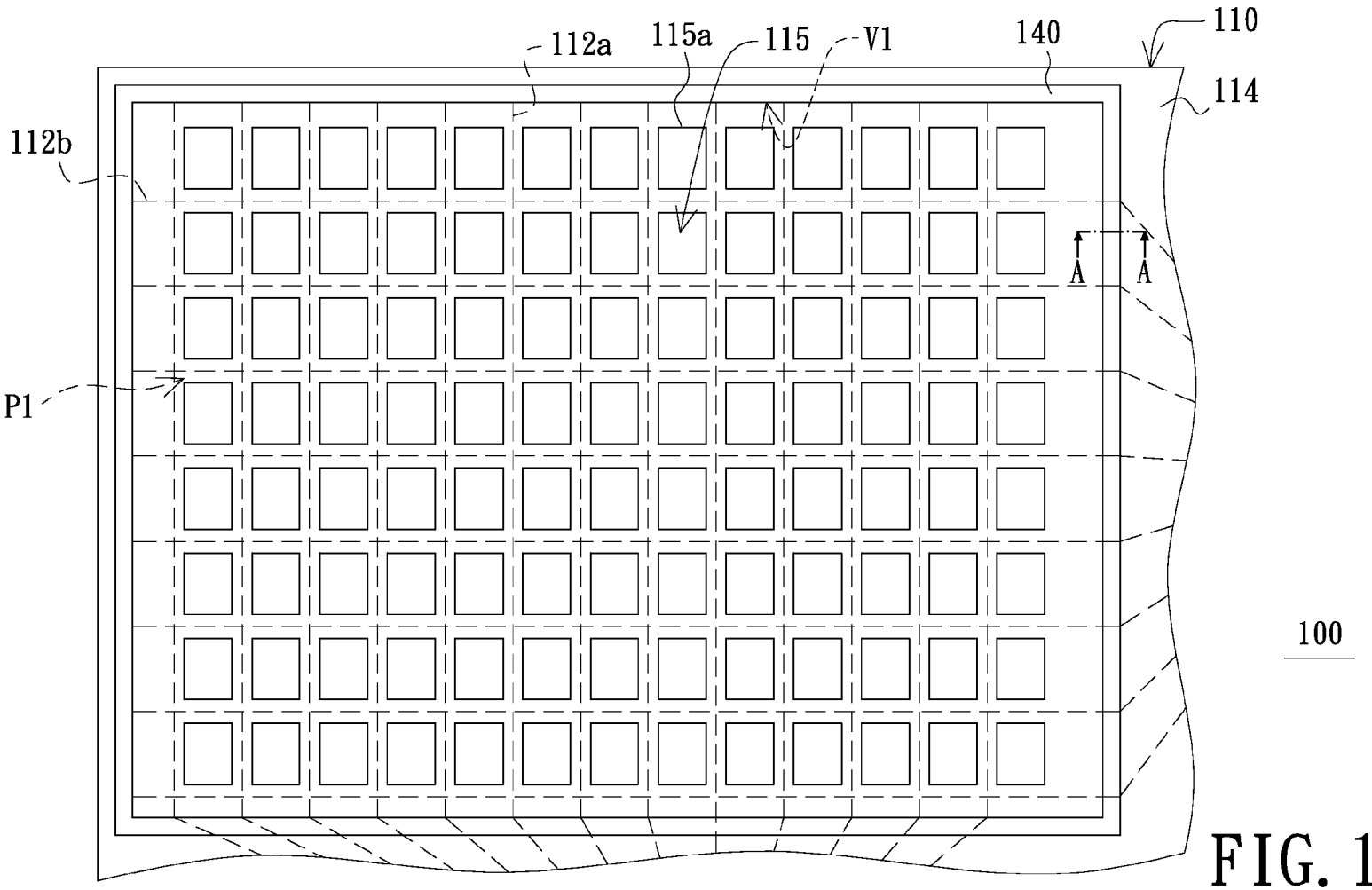
FIG. 1A (Prior Art)
FIG. 1A is a schematic top view of a conventional display panel.
Figure 1B:
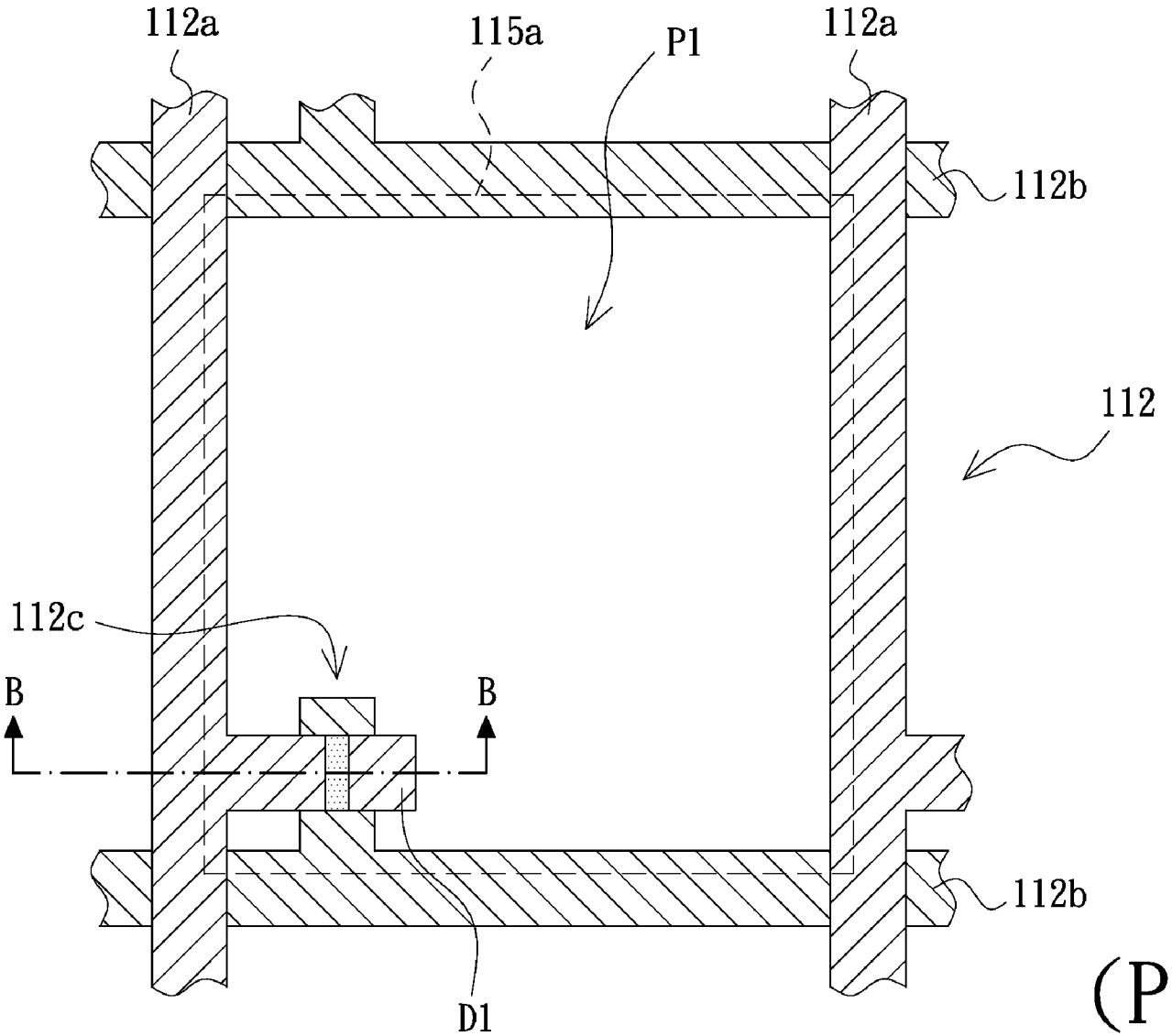
FIG. 1B (Prior Art)
FIG. 1B is a schematic top view of one of the pixel unit areas of the display panel shown in FIG. 1A.
Figure 1C:
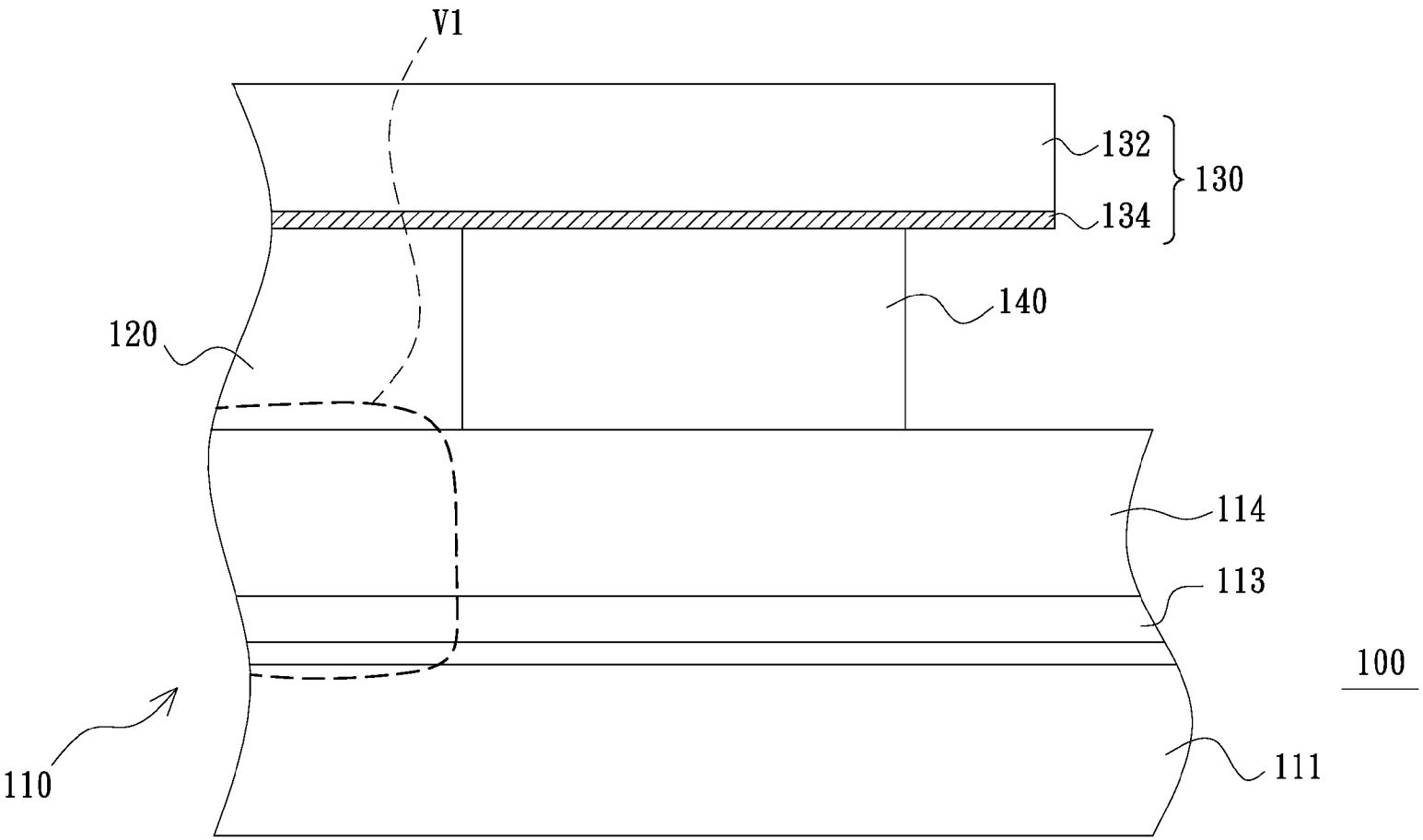
FIG. 1C (Prior Art)
FIG. 1C is a cross-sectional view of the display panel of FIG. 1A taken along line A-A.
Figure 1D:
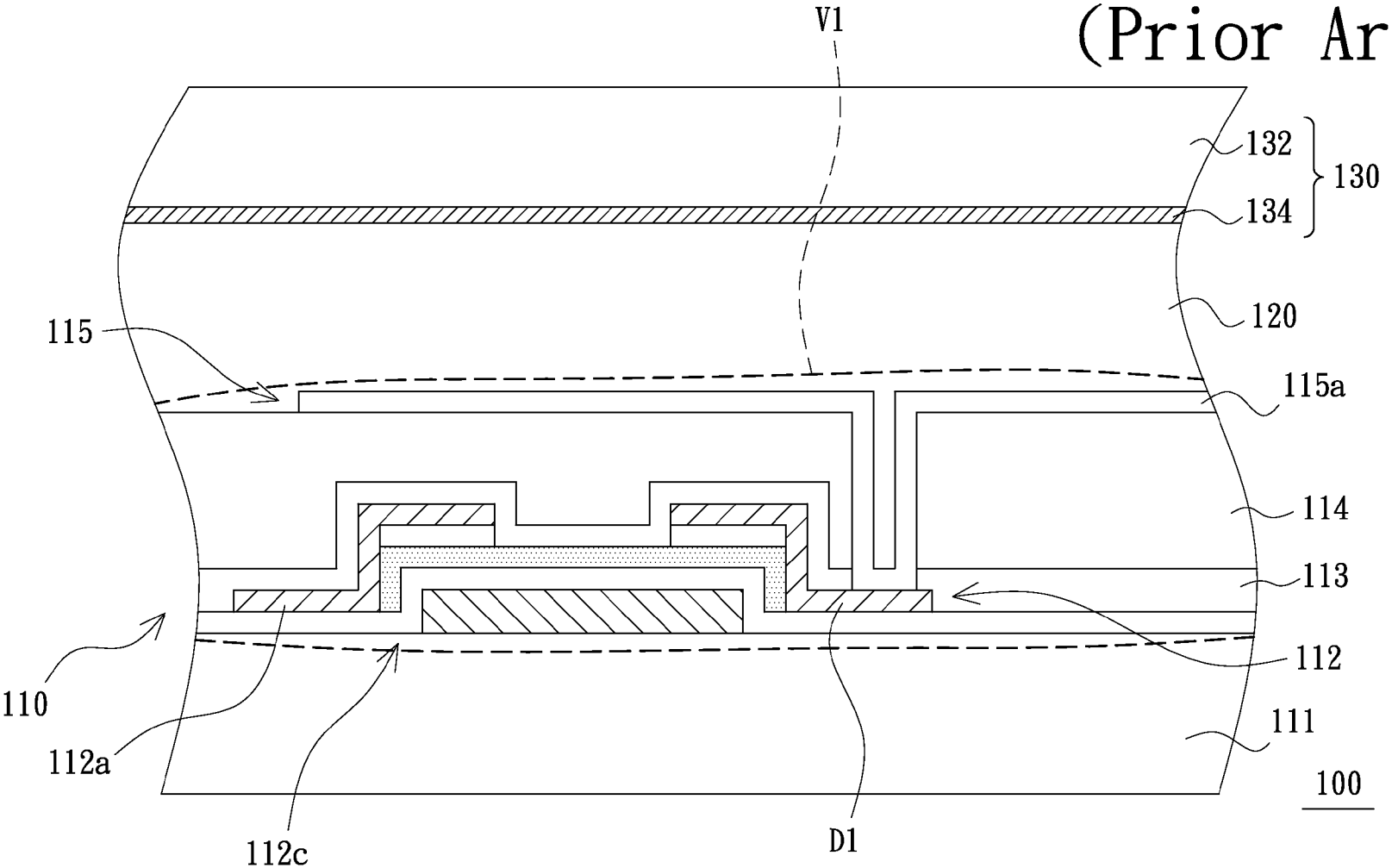
FIG. 1D (Prior Art)
FIG. 1D is a cross-sectional view of the pixel unit area of FIG. 1B taken along line B-B.
Figure 2A:
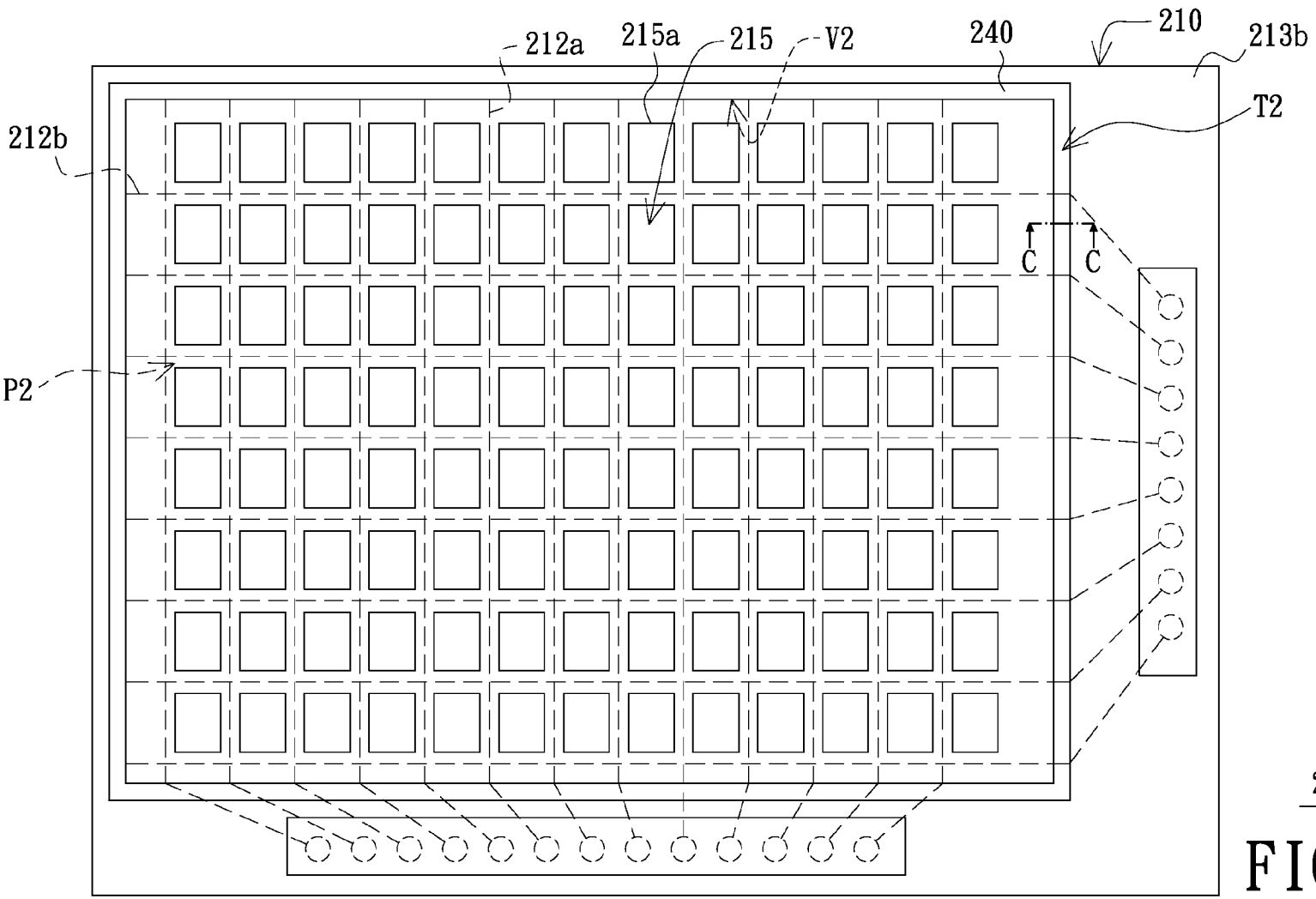
FIG. 2A is a schematic top view of a display panel in accordance with an embodiment of present invention.
Figure 2B:
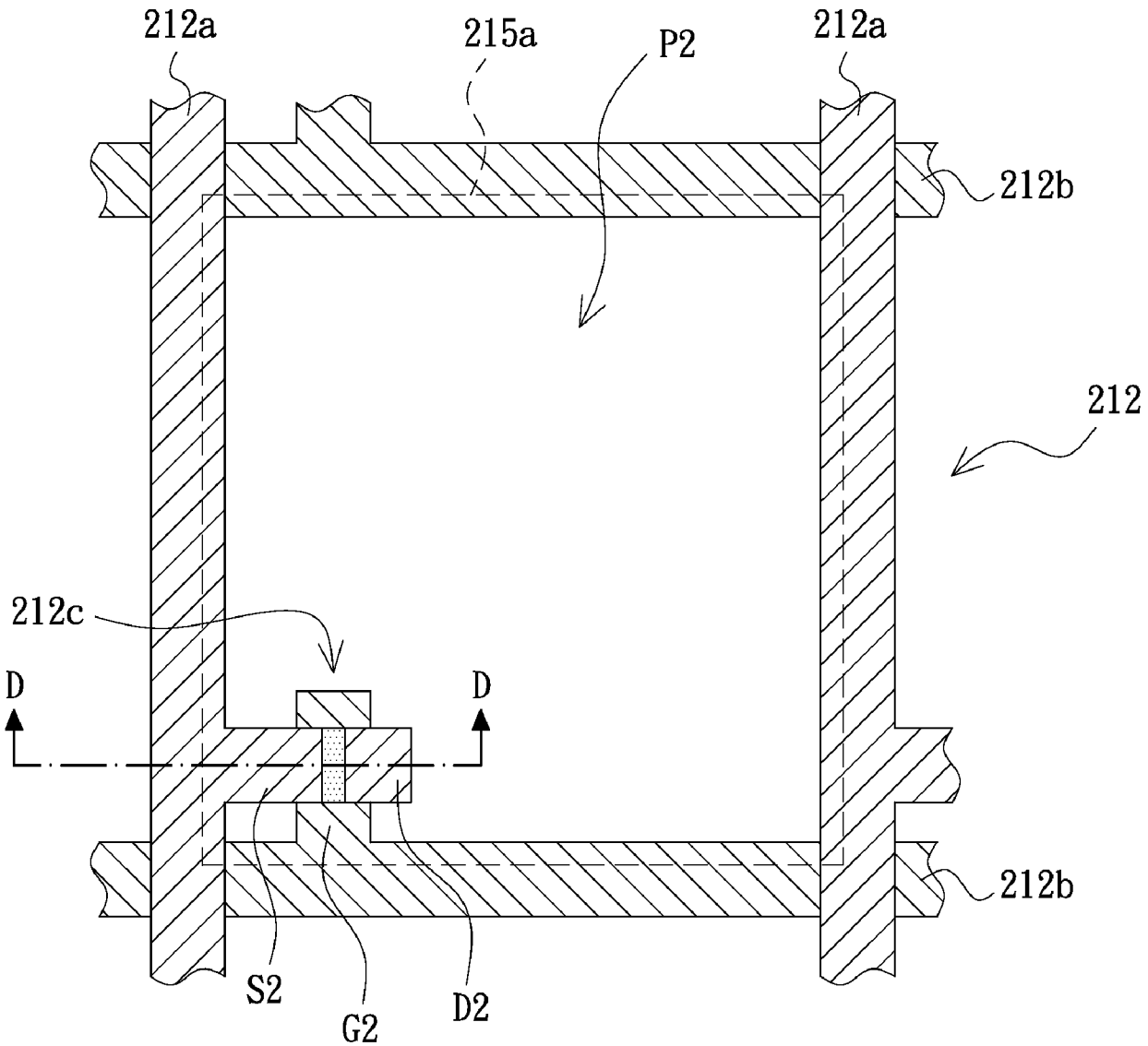
FIG. 2B is a schematic top view of one of the pixel unit areas of the display panel shown in FIG. 2A.
Figure 2C:
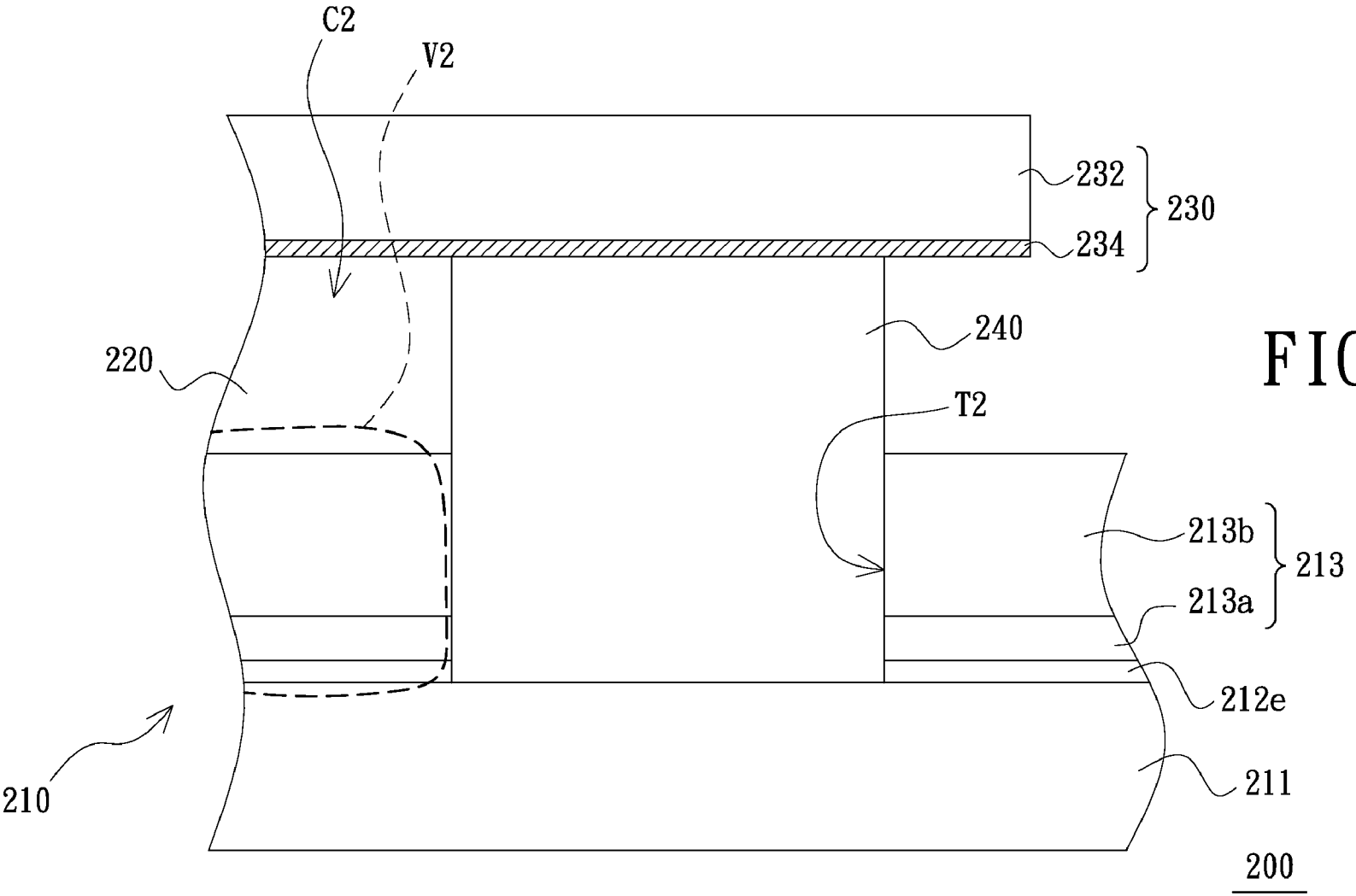
FIG. 2C is a cross-sectional view of the display panel of FIG. 2A taken along line C-C.
Figure 2D:
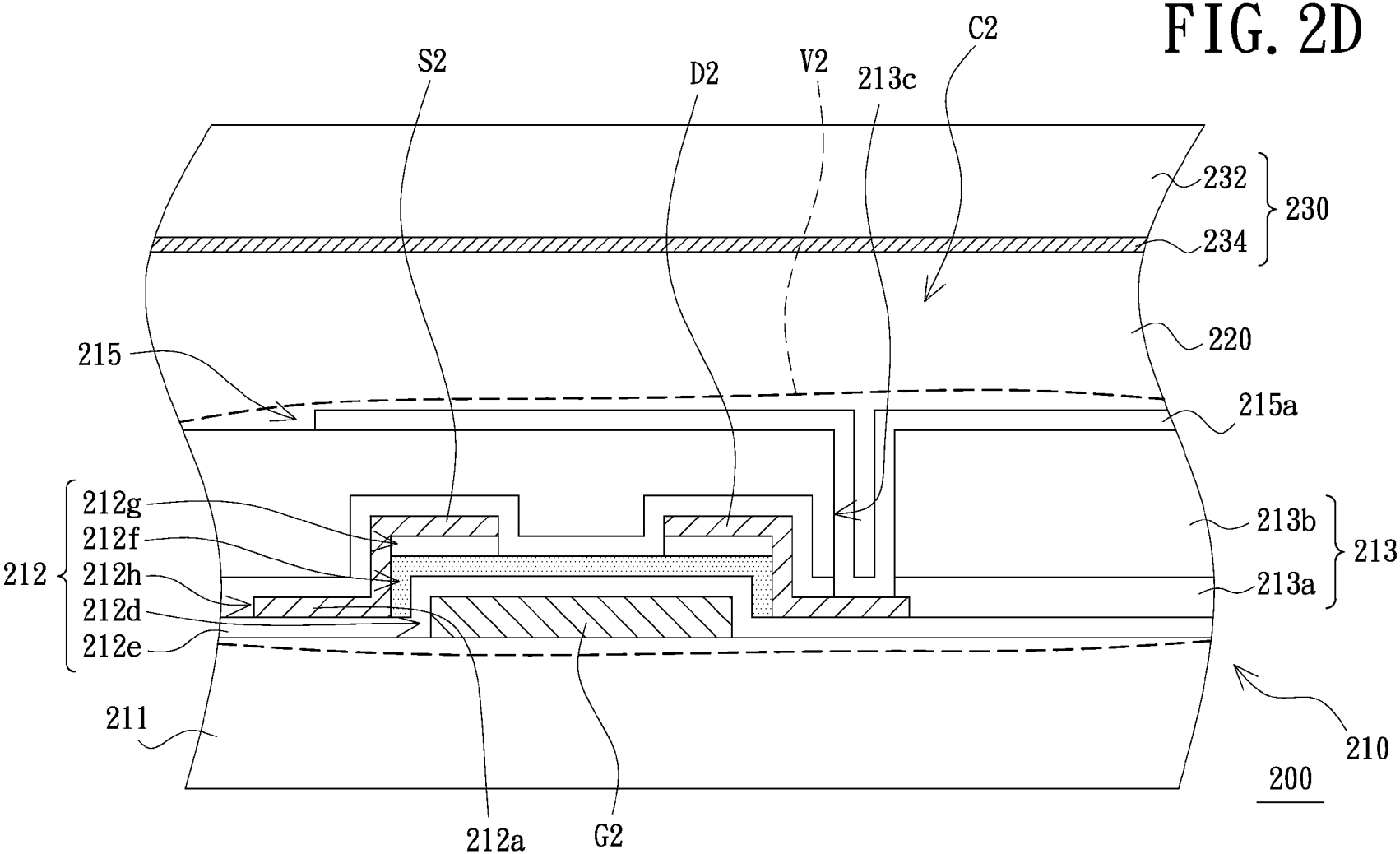
FIG. 2D is a cross-sectional view of the pixel unit area of FIG. 2B taken along line D-D.

FIG. 2A is a schematic top view of a display panel in accordance with an embodiment of present invention. FIG. 2B is a schematic top view of one of the pixel unit areas of the display panel shown in FIG. 2A. FIG. 2C is a cross-sectional view of the display panel of FIG. 2A taken along line C-C. FIG. 2D is a cross-sectional view of the pixel unit area of FIG. 2B taken along line D-D. It should be pointed out that for the convenience of illustration, some elements of the display panel are omitted in FIG. 2A and the pixel electrode in FIG. 2B is represented by a broken line. Referring to FIGS. 2A, 2B, 2C and 2D, a display panel 200 of the present embodiment includes a first substrate 210, a display layer 220, a second substrate 230 and a water-proofing frame 240. The first substrate 210 has a view area V2 and includes a first base 211, a circuit layer 212, a bibulous insulating layer 213 and a pixel-electrode layer 215.

The circuit layer 212 is disposed on the first base 211 and includes a first metal layer 212*d*, a gate-insulating layer 212*e*, a semiconductor layer 212*f*, an ohm contact layer 212*g* and a second metal layer 212*h*. The first metal layer 212*d* is disposed on the first base 211. The gate-insulating layer 212*e* is disposed on the first base 211 and covers at least a part of the first metal layer 212*d*. The second metal layer 212*h* is disposed on the gate-insulating layer 212*e* and exposes a part of the gate-insulating layer 212*e*. The semiconductor layer 212*f* is disposed on the first base 211. In the embodiment, the gate-insulating layer 212*e*, the semiconductor layer 212*f* and the ohm contact layer 212*g* are disposed in order between the first metal layer 212*d* and the second metal layer 212*h*.

A plurality of switching elements 212*c* are composed of a part of the first metal layer 212*d*, a part of the second metal layer 212*h*, a part of the gate-insulating layer 212*e*, the semiconductor layer 212*f* and the ohm contact layer 212*g*. A plurality of data lines 212*a* and a plurality of scan lines 212*b* are composed of the other part of the first metal layer 212*d* and the other part of the second metal layer 212*h*. A plurality of pixel unit areas P2 are separated by the data lines 212*a* and the scan lines 212*b*. The pixel unit areas P2 are located in the view area V2. Each of the switching elements 212*c* is electrically connected to one of the data lines 212*a* and one of the scan lines 212*b*. Each of the switching elements 212*c* is disposed in one of the pixel unit areas P2.

In detail, for example, each of the switching elements 212*c* is a TFT having a gate electrode G2, a source electrode S2 and a drain electrode D2. The gate electrode G2 of each of the switching elements 212*c* such as TFTs is electrically connected to the corresponding scan line 212*b*. The source electrode S2 of each of the switching elements 212*c* such as TFTs is electrically connected to the corresponding data line 212*a*. The drain electrode D2 of each of the switching elements 212*c* such as TFTs is electrically connected to a corresponding pixel electrode 215*a* (see the following description). In the embodiment, the first metal layer 212*d* includes the gate electrode G2 of each of the switching elements 212*c* such as TFTs and the scan lines 212*b*. The second metal layer 212*h* includes the source electrode S2 and the drain electrode D2 of each of the switching elements 212*c* such as TFTs and the data lines 212*a*.

The bibulous insulating layer 213 is disposed on the second metal layer 212*h* and the gate-insulating layer 212*e*. In the embodiment, the bibulous insulating layer 213 includes a passivation layer 213*a* and a bibulous planarization layer 213*b*. The material of the passivation layer 213*a* may be silicon nitride. The material of the bibulous planarization layer 213*b* may include the material of a photoresist such as resin. The passivation layer 213*a* is disposed on the second metal layer 212*h* and the gate-insulating layer 212*e*. The bibulous planarization layer 213*b* is disposed on the passivation player 213*a*. The bibulous insulating layer 213 exposes a part of each of the switching elements 212*c*, that is, a plurality of contact hole 213*c* of the bibulous insulating layer 213 respectively expose the drain electrodes D2 of the switching elements 212*c* such as TFTs. In addition, the first substrate 210 has a ring-shaped through trench T2 surrounding the view area V2. The ring-shaped through trench T2 passes through the bibulous planarization layer 213*b* and the passivation layer 213*a* of the bibulous insulating layer 213 and passes through the part of the gate-insulating layer 212*e* exposed by the second metal layer 212*h* to expose a part of the first base 211.

The pixel-electrode layer 215 is disposed on the bibulous planarization layer 213*b* of the bibulous insulating layer 213. The pixel-electrode layer 215 includes a plurality of pixel electrodes 215*a* that respectively corresponds to the pixel unit areas P2. Each of the pixel electrodes 215*a* is located in the view area V2. Through the corresponding contact hole 213*c*, each of the pixel electrodes 215*a* is electrically connected to the drain electrode D2 of one of the switching elements 212*c* such as TFTs.

The display layer 220 is disposed on the pixel-electrode layer 215 and corresponds to the view area V2 of the first substrate 210. In the embodiment, the display layer 220 is, for example, an electrophoresis layer that has a plurality of microcapsules (not shown) and electrophoretic fluid filling each of the microcapsules. The electrophoretic fluid in each microcapsule includes dielectric liquid and a plurality of electrophoretic particles dispersed in the dielectric liquid. Besides, the microcapsules can be replaced by a plurality of microcups and the scope of the present invention is not limited herein. In another embodiment, the display layer 220 may be a liquid crystal layer or an OLED layer but not shown in any drawings.

The second substrate 230 is disposed on the display layer 220 and includes a second base 232 and a common-electrode layer 234. The common-electrode layer 234 is disposed between the second base 232 and the display layer 220. The water-proofing frame 240 is disposed at the ring-shaped through trench T2 and connects the first substrate 210 and the second substrate 230. In the embodiment, the water-proofing frame 240 is adhesive so that it can bond the first substrate 210 and the second substrate 230. The water-proofing frame 240 encloses a wet-proof space C2 between the first substrate 210 and the second substrate 230. The view area V2, the display layer 220, a part of the bibulous insulating layer 213 and a part of the gate-insulating layer 212*e* are disposed in the wet-proof space C2.

The water-proofing frame 240 connects the first substrate 210 and the second substrate 230 and encloses a wet-proof space C2 between the first substrate 210 and the second substrate 210 and the view area V2, the display layer 220, a part of the bibulous insulating layer 213 and a part of the gate-insulating layer 212*e* are disposed in the wet-proof space C2. Therefore, compared with the prior art, the switching elements 212*c* in the view area V2 and the display layer 220 corresponding to the view area V2 of the display panel 200 in the embodiment can not be affected inversely or damaged by the moisture from outer environment such that the reliability of the display panel 200 is improved.

In addition, in the embodiment, the ring-shaped through trench T2 passes through the bibulous insulating layer 213 and the part of the gate-insulating layer 212*e* exposed by the second metal layer 212*h*, so the ring-shaped through trench T2 and other patterns of the bibulous insulating layer 213, e.g. the contact holes 213*c*, can be formed through a photo mask process. Therefore, without increasing any additional photo mask process, the manufacture of the display panel 200 of the present embodiment can be integrated with traditional numbers of photo mask processes, e.g. 5 photo mask processes. Further, in a second embodiment, the passivation layer 213*a* can be omitted.

Particularly, in a third embodiment, the part of the bibulous insulating layer 213 which is located outside the water-proofing frame 240 and the part of the gate-insulating layer 212*e* which is located outside the water-proofing frame 240 and exposed by the second metal layer 212*h* can be removed. In other words, the bibulous insulating layer 213 and the part of the gate-insulating layer 212*e* exposed by the second metal layer 212*h* can be wholly disposed in the wet-proof space C2.

According to the mentioned above, the bibulous insulating layer 213 and the part of the gate-insulating layer 212*e* exposed by the second metal layer 212*h* can be wholly disposed in the wet-proof space C2, so the pattern of the bibulous insulating layer 213 and the pattern of the gate-insulating layer 212*e* can also be formed through a photo mask process. Therefore, the manufacture of the display panel 200 in the third embodiment can be integrated with traditional numbers of photo mask processes.

To sum up, the display panel of the embodiment of the present invention has at least one of the following advantages or another advantage:

First, the water-proofing frame connects the first substrate and the second substrate and encloses a wet-proof space between the first substrate and the second substrate and the view area, the display layer and at least a part of the bibulous insulating layer are disposed in the wet-proof space. Thus, compared with the prior art, the switching elements in the view area and the display layer corresponding to the view area of the display panel of the embodiment of the present invention can not be affected inversely or damaged by the moisture from outer environment, such that the reliability of the display panel is improved.

Second, the ring-shaped through trench passes through the bibulous insulating layer and the part of the gate-insulating layer exposed by the second metal layer, so the ring-shaped through trench and other patterns of the bibulous insulating layer can be formed through a photo mask process. Therefore, the manufacture of the display panel of the embodiment of the present invention can be integrated with traditional numbers of photo mask processes.

Third, the bibulous insulating layer and the part of the gate-insulating layer exposed by the second metal layer can be wholly disposed in the wet-proof space, so the pattern of the bibulous insulating layer and the pattern of the gate-insulating layer can be formed through a photo mask process. Therefore, the manufacture of the display panel of the embodiment of present invention can be integrated with traditional numbers of photo mask processes.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A display panel, comprising:

a first substrate having a view area and a ring-shaped though trench and comprising:

a first base;

a first metal layer disposed on the first base;

a gate-insulating layer being disposed on the first base and covering at least a part of the first metal layer;

a second metal layer being disposed on the gate-insulating layer and exposing a part of the gate-insulating layer;

a semiconductor layer disposed on the first base, wherein a plurality of switching elements are composed of the first metal layer, the second metal layer, the gate-insulating layer and the semiconductor layer and the switching elements are disposed in the view area;

a bibulous insulating layer disposed on the second metal layer and the gate-insulating layer, wherein the ring-shaped through trench passes through the bibulous insulating layer and the part of the gate-insulating layer exposed by the second metal layer and surrounds the view area; and a pixel-electrode layer being disposed on the bibulous insulating layer and comprising a plurality of pixel electrodes, wherein each of the pixel electrodes is disposed in the view area and electrically connected to one of the switching elements;

a display layer being disposed on the pixel-electrode layer and corresponding to the view area;

a second substrate being disposed on the display layer and comprising a second base and a common-electrode layer, wherein the common-electrode layer is disposed between the second base and the display layer; and a water-proofing frame being disposed at the ring-shaped through trench, connecting the first substrate and the second substrate and enclosing a wet-proof space between the first substrate and the second substrate, wherein the view area, the display layer, part of the bibulous insulating layer and part of the gate-insulating layer are disposed in the wet-proof space.

2. The display panel as claimed in claim 1, wherein the bibulous insulating layer comprises a passivation layer disposed on the second metal layer and the gate-insulating layer and a bibulous planarization layer disposed on the passivation layer.

3. The display panel as claimed in claim 1, wherein the bibulous insulating layer is a bibulous planarization layer.

4. The display panel as claimed in claim 1, wherein the water-proofing frame is adhesive so as to bond the first substrate and the second substrate.

5. The display panel as claimed in claim 1, wherein the display layer is an electrophoresis layer, a liquid crystal layer or an organic light-emitting diode layer.

6. A display panel, comprising:

a first substrate having a view area and a ring-shaped though trench and comprising:

a first base;

a plurality of switching elements disposed on the first base and located in the view area; and a bibulous insulating layer disposed on the first base, wherein the bibulous insulating layer covers the switching elements, and the ring-shaped through trench passes through the bibulous insulating layer and surrounds the view area;

a display layer disposed on the first substrate and corresponded to the view area;

a second substrate disposed on the display layer; and a water-proofing frame disposed at the ring-shaped through trench and connected the first substrate and the second substrate, the water-proofing frame enclosing a wet-proof space between the first substrate and the second substrate, wherein the view area, the display layer and part of the bibulous insulating layer are disposed in the wet-proof space.

7. The display panel as claimed in claim 6, wherein the switching elements are thin film transistors.

8. The display panel as claimed in claim 6, wherein the bibulous insulating layer comprises:

a passivation layer disposed on the first base; and a bibulous planarization layer disposed on the passivation layer.

9. The display panel as claimed in claim 6, wherein the bibulous insulating layer is a bibulous planarization layer.

10. The display panel as claimed in claim 6, wherein the water-proofing frame is adhesive so as to bond the first substrate and the second substrate.

11. The display panel as claimed in claim 6, wherein the display layer is an electrophoresis layer, a liquid crystal layer or an organic light-emitting diode layer.

* * * * *